US009923280B2

(12) United States Patent
Segador et al.

(10) Patent No.: US 9,923,280 B2
(45) Date of Patent: Mar. 20, 2018

(54) DUAL POLARIZED DIPOLE ANTENNA

(71) Applicant: Intel Corporation, Santa Clara, CA (US)

(72) Inventors: Juan Segador, Los Angeles, CA (US); Istvan Bartha, Los Angeles, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/432,257

(22) PCT Filed: Oct. 23, 2013

(86) PCT No.: PCT/US2013/066340

§ 371 (c)(1),
(2) Date: Mar. 30, 2015

(87) PCT Pub. No.: WO2014/070549

PCT Pub. Date: May 8, 2014

(65) Prior Publication Data

US 2015/0255882 A1 Sep. 10, 2015

Related U.S. Application Data

(60) Provisional application No. 61/720,184, filed on Oct. 30, 2012.

(51) Int. Cl.
*H01Q 21/26* (2006.01)
*H01Q 9/28* (2006.01)
(Continued)

(52) U.S. Cl.
CPC ..... *H01Q 21/26* (2013.01); *H01Q 9/285* (2013.01); *H01Q 1/246* (2013.01); *H01Q 19/108* (2013.01)

(58) Field of Classification Search
CPC ..... H01Q 21/26; H01Q 9/18; H01Q 19/108
See application file for complete search history.

(56) References Cited

U.S. PATENT DOCUMENTS 6,717,555 B2 4/2004 Teillet et al.
7,053,852 B2 5/2006 Timofeev
(Continued)

FOREIGN PATENT DOCUMENTS

CN 1577974 A 2/2005
CN 1688067 A 10/2005
(Continued)

OTHER PUBLICATIONS

"International Application Serial No. PCT/US2013/066340, International Search Report dated Mar. 27, 2014", 2 pgs.
(Continued)

*Primary Examiner* — Daniel J Munoz
(74) *Attorney, Agent, or Firm* — Schwegman Lundberg & Woessner, P.A.

(57) ABSTRACT

The present invention relates to a dual polarized dipole antenna (10) comprising a first dipole (21) and a second dipole (22); said first (21) and second (22) dipoles being substantially planar and being joined to each other to form a dual polarized dipole antenna (10); said dual polarized dipole antenna (10) including a separate parasitic cap element (50) attached to said first (21) and second (22) dipoles so as to secure said first (21) and second (22) dipoles to each other. The invention also includes an antenna system including a plurality of the dual polarized dipole antennas.

20 Claims, 6 Drawing Sheets

(51) Int. Cl.
*H01Q 1/24* (2006.01)
*H01Q 19/10* (2006.01)

(56) References Cited

U.S. PATENT DOCUMENTS

| | | | | |
|---|---|---|---|---|
| 2005/0179610 | A1 | 8/2005 | Le et al. | |
| 2005/0253769 | A1 | 11/2005 | Timofeev et al. | |
| 2006/0232490 | A1 | 10/2006 | Bisiules et al. | |
| 2007/0046558 | A1* | 3/2007 | Tillery | H01Q 1/246 343/797 |
| 2008/0231528 | A1* | 9/2008 | Guixa | H01Q 1/246 343/749 |
| 2012/0146871 | A1* | 6/2012 | Choi | H01Q 21/26 343/795 |
| 2012/0146872 | A1 | 6/2012 | Chainon et al. | |
| 2014/0327591 | A1* | 11/2014 | Kokkinos | H01Q 1/523 343/798 |

FOREIGN PATENT DOCUMENTS

| | | | | |
|---|---|---|---|---|
| CN | 201233958 | Y | 5/2009 | |
| CN | 201408837 | Y | 2/2010 | |
| CN | 201845866 | U | 5/2011 | |
| CN | 201918502 | U | 8/2011 | |
| CN | 102484321 | A | 5/2012 | |
| CN | 104854758 | A | 8/2015 | |
| WO | WO 2012102576 | A2 * | 8/2012 | H01Q 21/062 |
| WO | WO-2014/070549 | A1 | 5/2014 | |

OTHER PUBLICATIONS

"Chinese Application Serial No. 201380050990.3, Office Action dated Aug. 5, 2016", w/ English Translation, 13 pgs.
"European Application Serial No. 13850514.4, Extended European Search Report dated Jun. 7, 2016", 7 pgs.
"International Application Serial No. PCT/US2013/066340, International Preliminary Report on Patentability dated May 14, 2015", 5 pgs.

* cited by examiner

DUAL POLARIZED DIPOLE ANTENNA

This application is a U.S. National Stage Filing under 35 U.S.C. 371 from International Application No. PCT/US2013/066340, filed Oct. 23, 2013 and published in English as WO 2014/070549 on May 8, 2014, which claims the benefit of priority to U.S. Provisional Patent Application Ser. No. 61/720,184, filed Oct. 30, 2012, each of which is incorporated herein by reference in its entirety.

BACKGROUND OF THE INVENTION

1. Technical Field

The present invention relates to a dual polarized dipole antenna and to an antenna system comprising such antennas.

2. Description of the Prior Art

Dual polarized dipole antennas are well known in the art. They are often used in base station antenna systems for wireless communication systems, such as GSM, GPRS, EDGE, UMTS, LTE, LTE Advanced and WiMax systems. In these wireless systems they are often used in base station antenna arrays. The polarization employed in these types of antennas may be circular, elliptical or linear.

These types of antenna have two dipoles arranged such that the antenna radiates in two different polarizations. In its simplest form each dipole is made up of a two wire transmission line which is driven by a radio signal source in one end and an open circuit on the other end. There are also dipoles which are etched on a Printed Circuit Board (PCB) layer/substrate with dipole pattern etching.

A recent trend in the art is to use more broadband antennas in order to give an increased flexibility for deployments with regard to frequency bands without increasing the number of antenna units. For example, the previously used 1710-2170 MHz band antennas are today replaced by 1710-2690 MHz band antennas. This trend creates new technical challenges, e.g., the need of antenna elements with more bandwidth (i.e. ~45% versus previously ~25%; bandwidth of the element; that is, operation of, for example, bandwidth=(fmax−fmin/0.5(fmax+fmin)) and/or methods to get more bandwidth out of prior art designs.

A prior art dual polarized antenna (Master of Science Thesis: "Design of a broadband antenna element for LTE base station antennas" by Marie Ström, 2009 Chalmers University of Technology, Sweden) is comprised of two, on a PCB layer, printed dipoles mounted orthogonally to each other. Each of the printed dipoles also has associated parasitic element printed on the PCB to increase the bandwidth of the antenna. The parasitic element is printed on a PCB above the dipole pattern.

SUMMARY OF THE INVENTION

An object of the present invention is to provide a solution which mitigates or fully solves the problems of prior art solutions.

According to a first aspect of the invention, the mentioned objects are achieved with a dual polarized dipole antenna comprising a first dipole and a second dipole; said first and second dipoles being substantially planar and being joined to each other to form a dual polarized dipole antenna; said dual polarized dipole antenna further comprising a separate parasitic cap element attached to said first and second dipoles so as to secure said first and second dipoles to each other.

Different preferred embodiments of the dipole antenna above are defined in the appended claims.

According to a second aspect of the invention, the mentioned objects are also achieved with an antenna system comprising at least one array having a plurality of dual polarized dipole antennas according to the invention.

The present invention provides an antenna which is mechanically robust meaning that the two dipoles are fixed to each other in a predetermined position (e.g., 90-degrees angle between the dipoles when in operation) in a very secure way. Further, the present solution also means that the two dipoles will have substantially the same impedance thereby achieving improved antenna performance compared to the prior art solution described above.

Moreover, the antenna of the present invention is easy and cheap to manufacture thereby saving cost. Further advantages and applications of the present invention can be found in the following detailed description of the present invention.

DETAILED DESCRIPTION OF THE INVENTION

Figure 1:
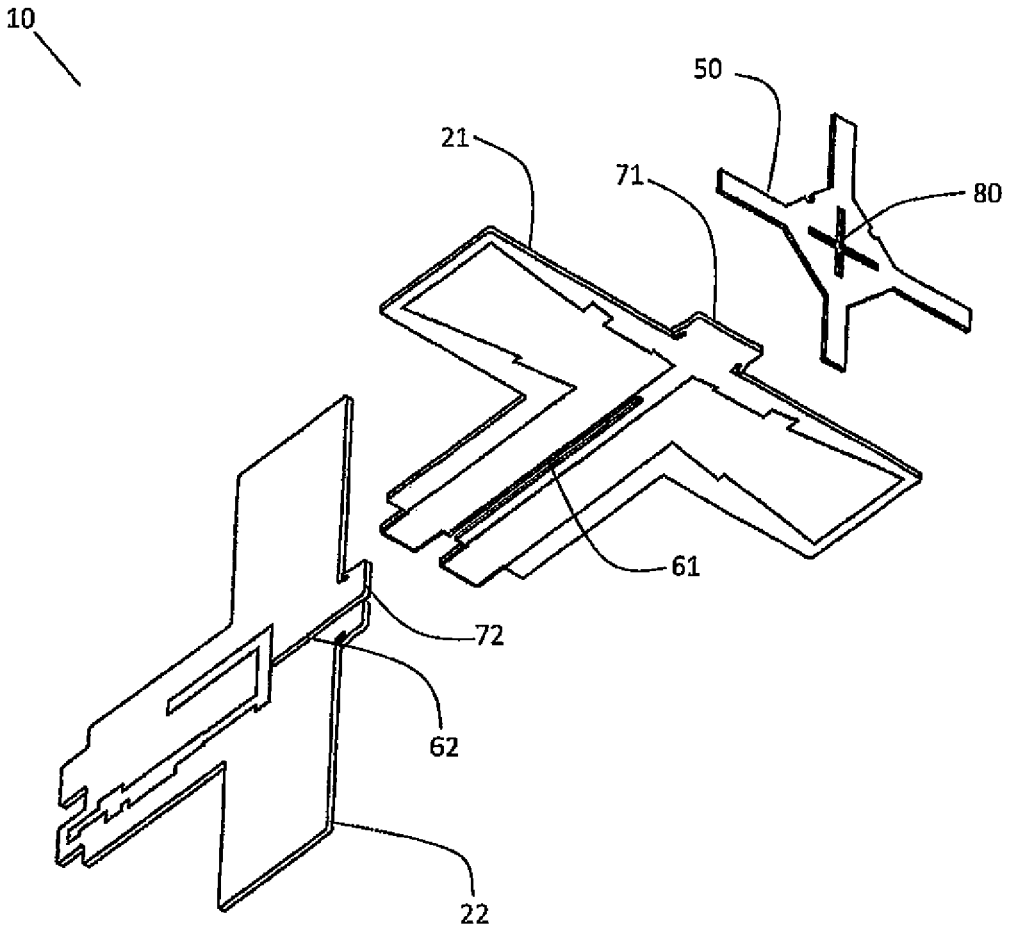
FIG. 1 is a perspective exploded view of an embodiment of a dual polarized antenna according to the present invention in which the two dipoles axe substantially T-shaped.

To achieve aforementioned and further objectives, the present invention relates to a dual polarized dipole antenna 10 comprising of first 21 and second 22 dipoles. The dipoles 21, 22 are substantially planar and are (in operation) joined to each other so that they together form the dual polarized antenna 10. The antenna 10 further includes a separate parasitic cap element 50, which is attached to the first and second dipoles 21, 22, and arranged such that the first and second dipoles 21, 22 are securely fixed to each other.

The present separate parasitic cap element 50 has an electrical and a mechanical function in the antenna 10. The electrical function is to increase the bandwidth of the antenna 10 while providing a substantially symmetric parasitic shape for the two orthogonal polarizations of the antenna 10. The parasitic cap element 50 introduces new resonances in the impedance curve of the dipole antenna 10 and thereby acts as an additional tuning element, making the dipole antenna 10 more broadband.

The mechanical function, on the other hand, is used to mechanically secure the first and second dipoles 21, 22 to each other, thereby providing a stable and robust antenna construction. The first and second dipoles 21, 22 will therefore be fixed to each other in a predetermined position (e.g., a fixed angle between the dipoles 21, 22) when in operation.

The prior art solution with printed parasitic elements on a PCB layer/substrate described above means that one of the dipoles must have its parasitic element discontinuously arranged, which implies that the two dipoles will have a need for different impedance tunings and therefore the radiation patterns may have unwanted asymmetries between the two polarizations. The configuration of the present antenna 10 eliminates such unwanted asymmetries.

The present antenna 10 is also easy to assemble, and simple and cheap to manufacture, as a seamless conductive parasitic element is provided with the present invention and no extra soldering or conductive component is needed to bridge an interrupted PCB pattern as in the prior art solutions discussed above.

FIG. 1 shows a first embodiment of the dual polarized dipole antenna 10 according to the present invention. The antenna 10 has the first and second dipoles 21, 22, which are made of preassembled dipoles from etched conductive dipole pattern on a PCB layer. As noted, the dipoles 21, 22 are perpendicularly joined to each other (i.e., 90-degree angle between the dipoles) and are in this particular embodiment joined to each other by means of first 61 and second 62 grooves arranged on each of the dipoles 21, 22, respectively. The first groove 61 starts from a lower edge of the first dipole 21 and extends upward, while the second groove 62 starts from an upper edge of the second dipole 22 and extends downward. The dipoles 21, 22 are inserted into the grooves 62, 61 of the respective other dipole when in operation. It is, however, to be understood that the dipoles 21, 22 may be joined to each other by other methods, such as soldering or by using adhesives, or combinations of other known methods in the art. It is further noted that the separate parasitic cap element 50 is attached to upper parts of the first and second dipoles 21, 22 so as to fix them together according to this embodiment.

As mentioned above, the present antenna 10 also includes the parasitic cap element 50, which in this case is substantially cross-shaped (i.e., it follows the shape of the two joined dipoles 21, 22) and is attached to the upper parts of respective dipoles 21, 22. The parasitic cap element 50 may, according to an embodiment of the invention, have recesses 80 corresponding to head parts 71, 72 of the dipoles 21, 22 such that the heads 71, 72 are press fitted into the corresponding recesses 80 when the antenna 10 is assembled. Hence, a very secure fit is achieved with this embodiment.

Figure 2:
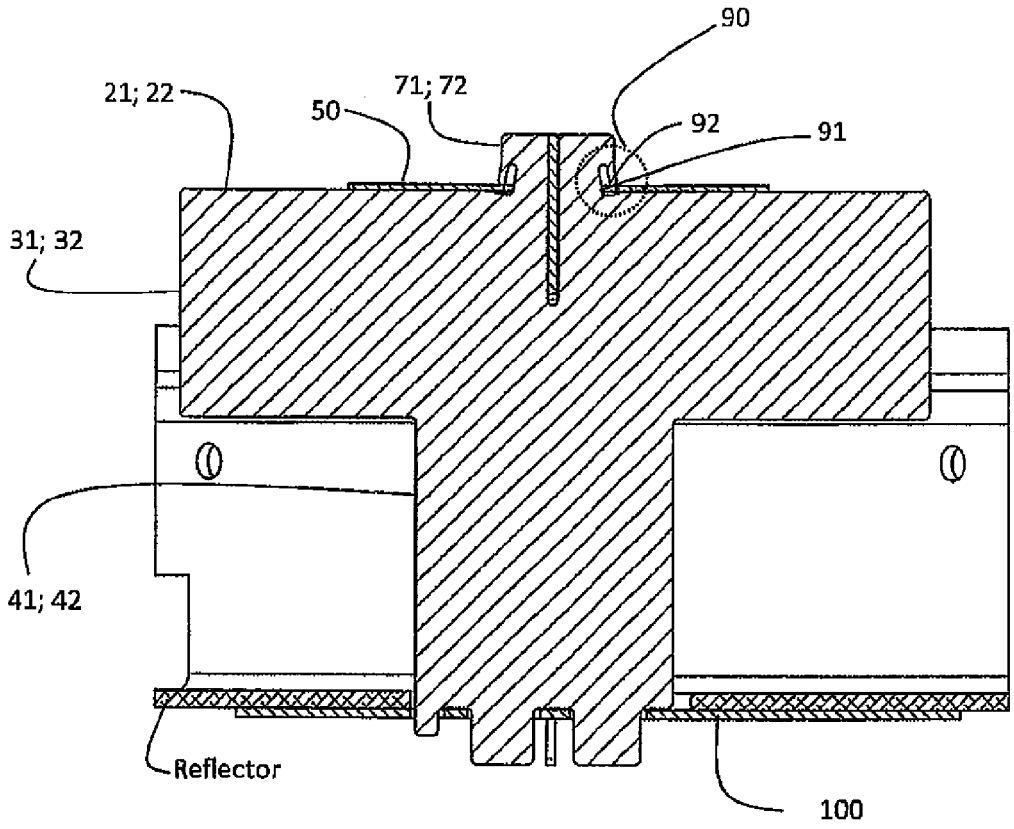
FIG. 2 is a side view of an embodiment of the invention.
Figure 4:
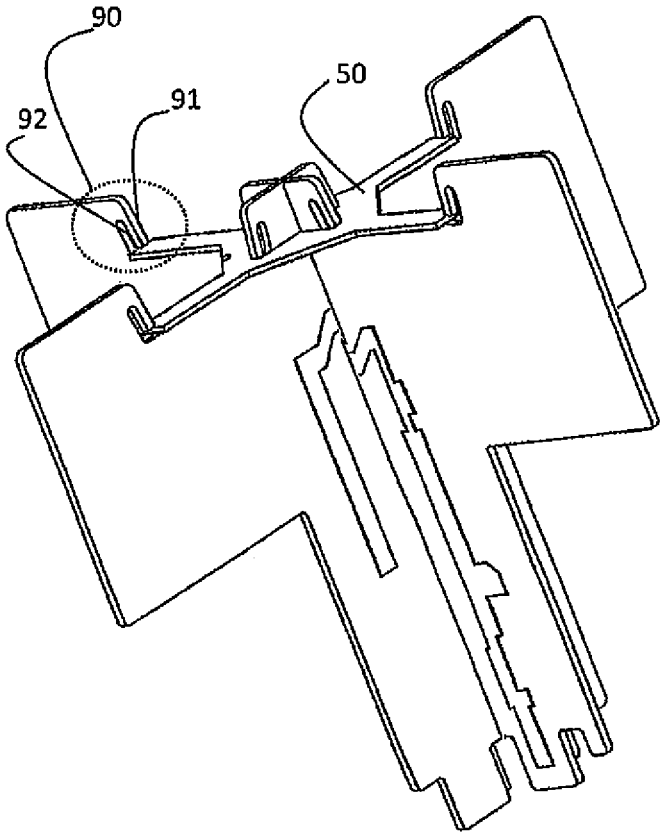
FIG. 4 is a perspective view of yet another embodiment of the invention in which the antennas has extra locking arrangements.

To further improve the mechanical securing of the two dipoles 21, 22 to each other, the antenna 10 may, according to another embodiment of the invention shown in FIGS. 2 and 4, have one or more locking arrangements 90 for locking the parasitic cap element 50 to the first and second dipoles 21, 22. The locking arrangements 90 may, according to an embodiment, be made up of a groove 91 and an associated locking tongue 92 arranged on suitable locations of the dipoles 21, 22, respectively. When the parasitic element 50 is fitted on the dipoles 21, 22, the locking tongue 92 locks the parasitic element 50 in a predetermined position by applying a locking (mechanical) force on the parasitic element 50 in that position.

Preferably, the parasitic element 50 is made of a separate sheet metal part, such as sheet aluminum. This is an easy and simple way of manufacturing the present parasitic cap element 50. The inventors have used sheet aluminum with a thickness of 0.5 mm with good performance for the 1700 and 2700 MHz band frequencies.

The parasitic cap element 50 may be substantially planar to make the manufacturing of the present antenna 10 easier. The parasitic cap element 50 may also extend substantially perpendicular to the first and second dipoles 21, 22 according to these particular embodiments. Further, the parasitic cap element 50 may also extend substantially along parts of upper edges of the first and second dipoles 21, 22 to increase the bandwidth and obtain the same radiation pattern for the two polarizations of the dual polarized dipole elements.

Figure 3:
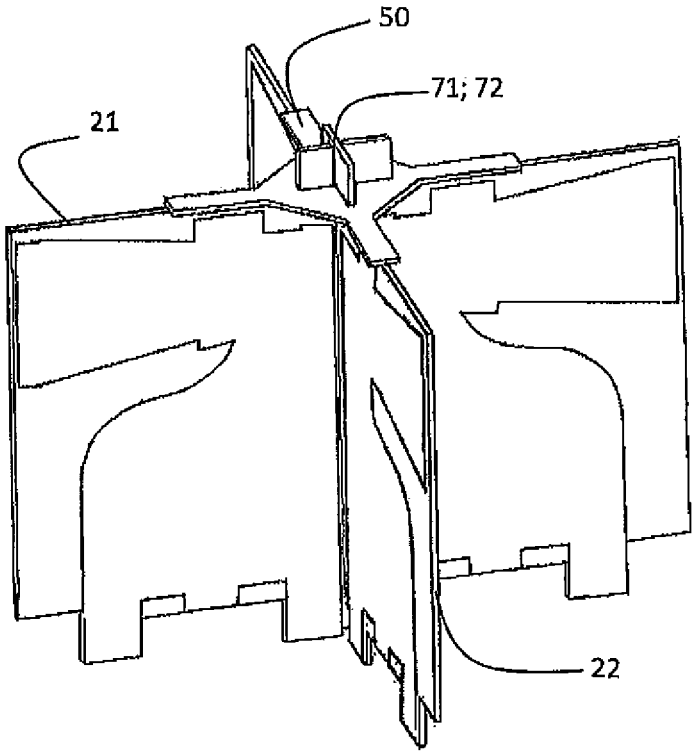
FIG. 3 is a perspective view of another embodiment of the invention in which the two dipoles are rectangular in shape.
Figure 5:
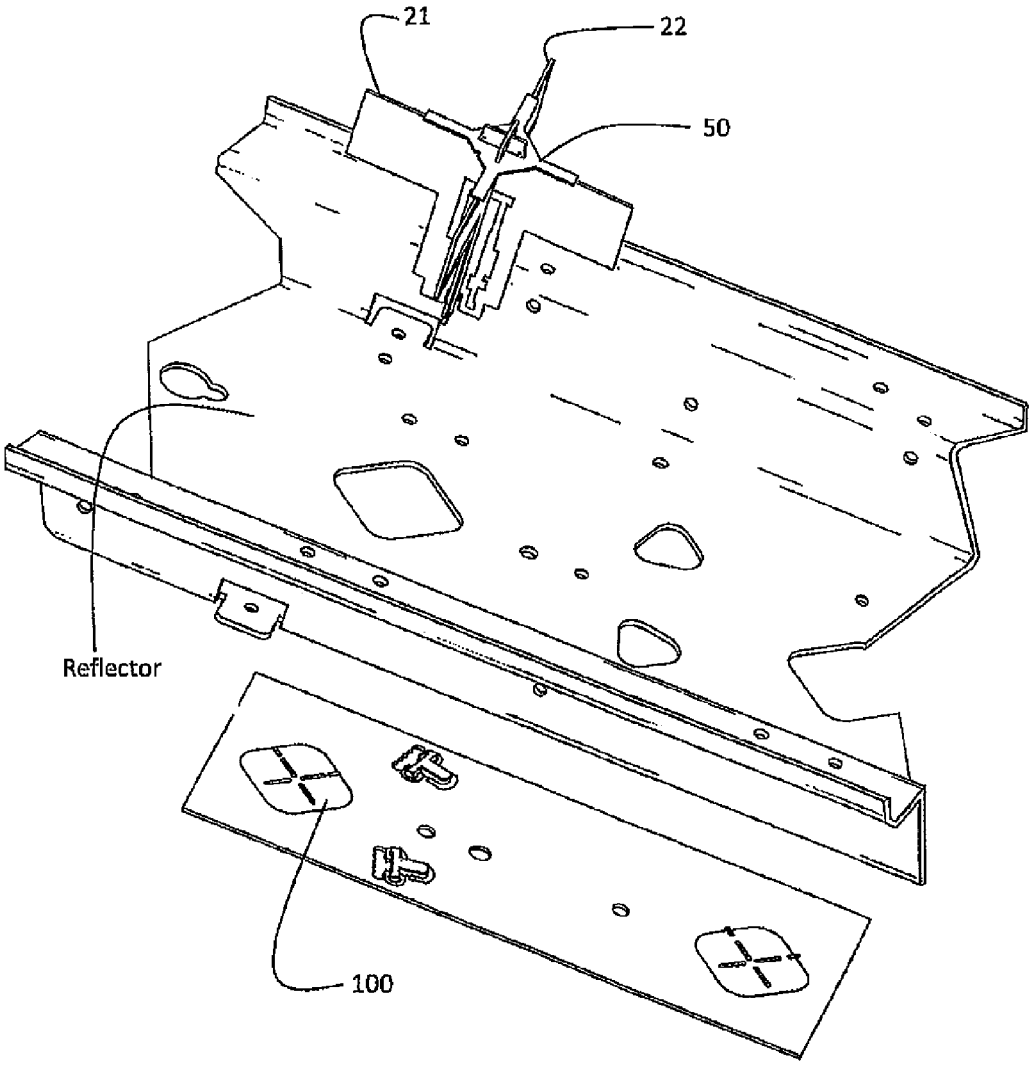
FIG. 5 is a perspective view of an embodiment of the invention over a reflector structure and a base layer of an antenna array.

The two dipoles 21, 22 may have a number of different shapes depending on the relevant antenna application. The embodiments of the antenna 10 in FIGS. 1-6 show dipoles etched on PCB having substantially rectangular shape or being substantially T-shaped. The embodiment in FIG. 3 shows an antenna with dipoles etched on PCB having rectangular shape (the balun design is different according to this embodiment). Each dipole 21, 22 further has a head arranged on the center of the upper edge of the dipole, and a downward directed protrusion arranged on the lower edge of the dipole for attaching the antenna to a base 100, which is shown in FIG. 5 and has corresponding receiving means for the protrusions of the diploes 21, 22.

The embodiment of the antenna shown in FIG. 4 has the dipoles 21, 22 being substantially T-shaped. The dipoles 21, 22 in this embodiment include the extra locking arrangements 90 (groove 91 and associated locking tongue 92) mentioned above arranged on the upper edges of the wings of the dipoles 21, 22. This is also possible with the rectangular arrangement by arranging locking arrangements 90 on the upper edges of the dipoles 21, 22. With the extra locking arrangements 90, the parasitic cap element 50 is even more securely attached to the dipoles 21, 22, and thereby further improves the fixation of the two dipoles 21, 22 to each other in a predetermined position.

Figure 6:
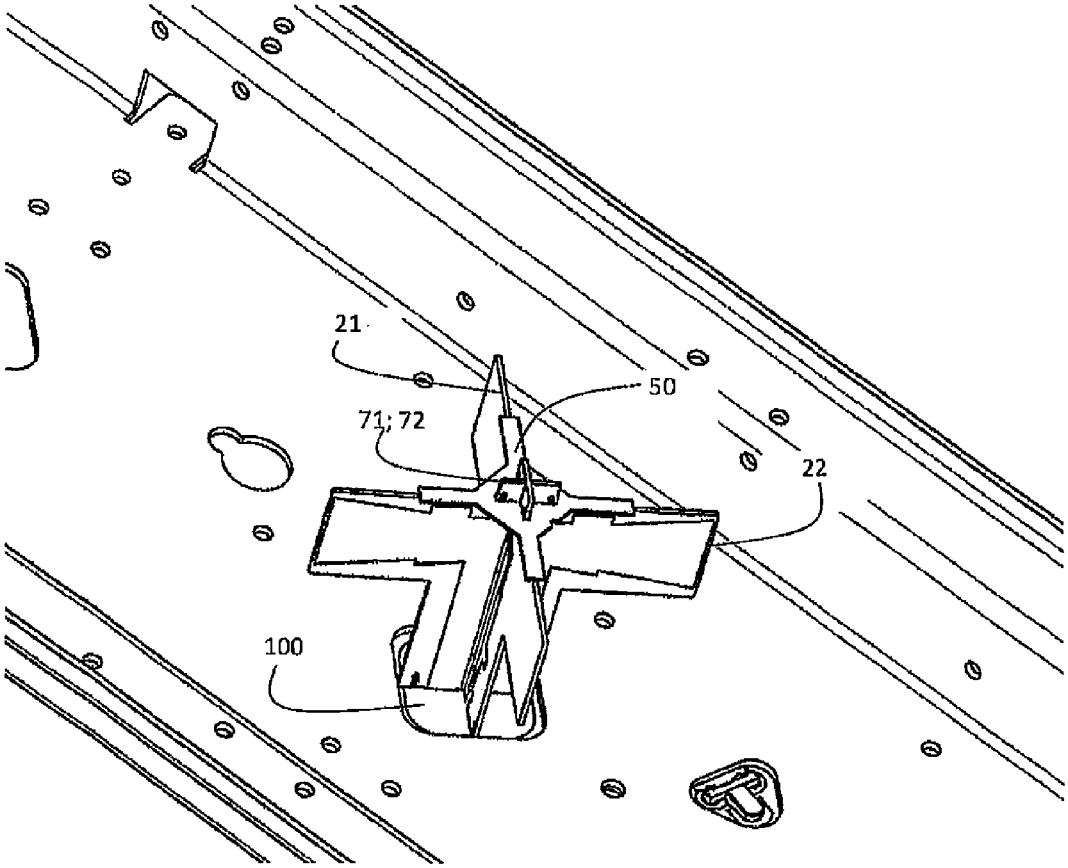
FIG. 6 is an embodiment of the invention mounted on the base layer of the antenna array.

According to yet another embodiment of the invention, the present antenna further includes the base 100 to which the first and second dipoles 21, 22 are attached in lower parts thereof. The base 100 is preferably made of a PCB substrate and includes feeding means arranged to feed the respective dipoles 21, 22 with radio frequency (RF) signals for excitation by the dipoles 21, 22 when in operation. FIGS. 5 and 6 show such an arrangement. The base 100 is arranged beneath a conductive reflector structure and the reflector structure has cut outs which expose the base 100 so that the antenna can be attached to the base 100 in these specific cut outs. The PCB of the dipole pair 21, 22 is attached to the base 100, e.g., by soldering, and the respective dipoles 21, 22 are electrically connected to the feeding means by known methods in the art. The dipoles 21, 22 may have protrusions at their lower edges for attachment to the base 100 as described above. The embodiments shown in FIGS. 5 and 6, with the antenna being attached to the base 100 at its lower edge and the parasitic cap element 50 attached at its upper edge, provides a very stable arrangement.

The present invention further provides an antenna system having one or more antenna arrays. These types of antennas are common in base stations for wireless communication systems, such as GSM, GPRS, EDGE, UMTS, LTE, LTB Advanced and WiMax. The arrays of the present antenna system have a plurality of antennas. FIGS. 5 and 6, respectively, show sections of such an antenna system. It should, however, be noted that multiband antennas can be designed with combinations of prior art/legacy antenna designs and antennas of the present invention.

Furthermore, as understood by the person skilled in the art, there are numerous ways of manufacturing the dipoles 21, 22 and the parasitic cap element 50, such as metallic dipoles, metalized plastics, etc. The following points out examples of some relevant methods of making these components.

Laminate made of plastics, with non-conductive area masked with, e.g., tape, thereafter metalized, e.g., by vacuum metallization.

Using plastic containing adhesive material, for example palladium, which, when exposed by, e.g., exposing pattern surface with a laser beam, makes plating of the surface possible.

Hot stamp: thin pattern made of conductive foil hot stamped to plastic laminate.

Pattern on soft PCB, polyester or capstone with a supporting non conductive laminate support structure.

Co-molded laminate, with one plastic material which can be plated and another plastic material which is not possible to metalize.

Pattern in laser/water-cut or stamped sheet metal or molded substantially flat metal parts separated by plastic dipole cap element with conductive top surface.

Metal decal on substrate (waxed paper, etc.) with glue on backside, which is taped onto laminate like a double adhesive tape where the carrier material is conductive.

Finally, it should be understood that the present invention is not limited to the embodiments described above, but also relates to and incorporates all embodiments within the scope of the appended claims.

What is claimed is:

1. A dual polarized dipole antenna comprising:

a first dipole and a second dipole, the first dipole and the second dipole each being substantially planar, being T-shaped and comprising two arms and a center section and being joined to each other to form a dual polarized dipole antenna; and an ungrounded parasitic cap element that includes at least one recess that extends through the parasitic cap element, into which parts of the first dipole and the second dipole are press fit so as to secure the first dipole and the second dipole to each other and to act as an additional tuning element to increase the bandwidth of the antenna.

2. The dual polarized dipole antenna according to claim 1, wherein the parasitic cap element is substantially planar.

3. The dual polarized dipole antenna according to claim 2, wherein the parasitic cap element extends substantially perpendicular to the first and second dipoles.

4. The dual polarized dipole antenna according to claim 3, wherein the parasitic cap element extends substantially along parts of upper edges of the first and second dipoles.

5. The dual polarized dipole antenna according to claim 1, wherein the parasitic cap element comprises a sheet metal part.

6. The dual polarized dipole antenna according to claim 1, wherein the first dipole comprises a first groove and the second dipole comprises a second groove, and the first dipole is inserted into the second groove, or vice versa, so as to join the first and second dipoles together.

7. The dual polarized dipole antenna according to claim 6, wherein the first groove extends upwardly from a lower edge of the first dipole and the second groove extends downwardly from an upper edge of the second dipole.

8. The dual polarized dipole antenna according to claim 1, wherein the first and second dipoles are perpendicularly joined to each other so as to form a cross shaped dipole antenna.

9. The dual polarized dipole antenna according to claim 1, wherein the first and second dipoles are substantially T-shaped or rectangular.

10. The dual polarized dipole antenna according to claim 1, wherein the first and second dipoles are made of printed circuit board having etched conductive dipole patterns.

11. The dual polarized dipole antenna according to claim 1, wherein the first dipole has at least a first head and the second dipole has at least a second head, and the at least one parasitic cap recess corresponds to the first and second heads, respectively, and wherein the heads are arranged to be press fitted in the at least one recess for attaching the parasitic cap element to the first and second dipoles.

12. The dual polarized dipole antenna according to claim 11, wherein the first and second dipoles each further includes at least one locking arrangement for locking the parasitic cap element to the first and second dipoles.

13. The dual polarized dipole antenna according to claim 12, wherein the locking arrangement comprises a groove with an associated locking tongue.

14. The dual polarized dipole antenna according to claim 1, further comprising a base, the base having feed circuitry to feed the first and second dipoles with radio frequency (RF) signals for excitation, and wherein the first and second dipoles are attached to the base around its lower edges and are electrically connected to the feed circuitry.

15. An antenna system for wireless communication systems comprising at least one antenna array having a plurality of dual polarized dipole antennas, wherein each of the plurality of dual polarized dipole antennas includes:

a first dipole and a second dipole, the first dipole and the second dipole each being substantially planar, being T-shaped and comprising two arms and a center section and being joined to each other to form a dual polarized dipole antenna; and an ungrounded parasitic cap element that includes at least one recess that extends through the parasitic cap element, into which parts of the first dipole and the second dipole are press fit so as to secure the first dipole and the second dipole to each other and to act as an additional tuning element to increase the bandwidth of the antenna.

16. The antenna system of claim 15 wherein the first dipole comprises a first groove and the second dipole comprises a second groove, and the first dipole is inserted into the second groove, or vice versa, so as to join the first and second dipoles together.

17. The antenna system of claim 16, wherein the first groove extends upwardly from a lower edge of the first dipole and the second groove extends downwardly from an upper edge of the second dipole.

18. The antenna system of claim 17 wherein the antenna system is configured for use in an LTE or LTE-A base station or enhanced node B (eNB).

19. The antenna system of claim 15, wherein the parasitic cap element is substantially planar, extends substantially perpendicular to the first and second dipoles, extends substantially along parts of upper edges of the first and second dipoles, or comprises a sheet metal part.

20. A method of communicating radio frequency (RF) signals with an antenna system comprising at least one antenna array having a plurality of dual polarized dipole antennas, wherein each of the plurality of dual polarized dipole antennas includes:

a first dipole and a second dipole, the first dipole and the second dipole each being substantially planar, being T-shaped and comprising two arms and a center section and being joined to each other to form a dual polarized dipole antenna; and an ungrounded parasitic cap element that includes at least one recess that extends through the parasitic cap element, into which parts of the first dipole and the second dipole are press fit so as to secure the first dipole and the second dipole to each other and to act as an additional tuning element to increase the bandwidth of the antenna, wherein the method includes feeding the first dipole and the second dipole with RF signals for excitation, and wherein the first dipole and the second dipole are attached to a base around its lower edges and are electrically connected to feed circuitry.

* * * * *